United States Patent [19]

Savage et al.

[11] 4,375,760

[45] Mar. 8, 1983

[54] ANVIL FOR RIVETING TOOL

[75] Inventors: Donald S. Savage, St. Albans; Raymond D. Lacey, Essendon, both of England

[73] Assignee: Aerpat A.G., Zug, Switzerland

[21] Appl. No.: 183,453

[22] Filed: Sep. 2, 1980

[30] Foreign Application Priority Data

Sep. 7, 1979 [GB] United Kingdom ..... 7931178

[51] Int. Cl.[3] ..... B21J 15/34

[52] U.S. Cl. ..... 72/391

[58] Field of Search ..... 72/391, 114, 465, 476; 29/243.53

[56] References Cited

U.S. PATENT DOCUMENTS 3,144,158 8/1964 Nouvelet ..... 72/391

3,898,835 8/1975 Winter ..... 72/465

*Primary Examiner*—Gene Crosby

*Attorney, Agent, or Firm*—Oblon, Fisher, Spivak, McClelland & Maier

[57] ABSTRACT

An anvil for a blind riveting tool comprises an annular disc 23 of resilient nylon-6 material received in a counterbore in the front of a rigid backing or mount 25. When the tool is used to place a blind rivet, the nylon disc contacts the rivet shell head to support it against the pull of the mandrel. The disc is flexible enough to conform to the shape of the rivet head, thus maximizing the contact area and minimizing the contact thrust, and is soft enough not to damage or mark the rivet head surface, which may, for example, be painted.

6 Claims, 5 Drawing Figures

ANVIL FOR RIVETING TOOL

The invention relates to an anvil for a riveting tool, more particularly for a riveting tool of the type for use with a rivet comprising a shell having a head at one end which, is use, is supported against the anvil whilst the tool pulls a mandrel or stem into and/or through the shell. Such a riveting tool is hereinafter referred to as "a riveting tool of the type defined".

The mandrel may be non-reusable, so that both shell and mandrel together form the rivet. Alternatively, the mandrel may be reusable on successive shells, so that a shell alone forms the rivet.

The invention provides, in one of its aspects, an anvil for a riveting tool of the type defined, which anvil has at least the part thereof which in use contacts the shell formed of a resilient material which is strong enough to support the shell against the pull on the mandrel and is soft enough not to damage the surface of the shell head.

Preferably the anvil includes a rigid part which at least partially surrounds the resilient part so that, in use of the anvil in a riveting operation, the rigid part limits the extent of deformation of the resilient part under the load applied thereto by the shell.

Preferably the anvil includes a rigid part providing a backing or mount for the resilient part, and a bore extending through both parts for reception of the mandrel during a riveting operation, the cross-sectional dimension of the bore being greater in the resilient part than in the rigid portion.

The invention also provides an anvil for a riveting tool of the type defined, which anvil has at least the part thereof which in use contacts the shell head formed of a material which is sufficiently flexible to conform to the shape of the shell head surfce. This maximizes the contact area and minimizes the contact pressure (for a given force) between the anvil and shell surfaces, with a consequent reduction in the likelihood of marking or damaging the shell surface.

The invention includes a riveting tool of the type defined, incorporating an anvil as claimed in any of the preceding claims.

The invention provides, in another of its aspects, a method of placing a rivet comprising a shell, which method comprises:

pulling a mandrel or stem into and/or through the shell whilst supporting the shell by means of an anvil which has at least the part which contacts the shell formed of a resilient material whereby the surface of the shell is not damaged by contact with the anvil.

The invention also provides a method of placing a rivet comprising a shell, which method comprises:

pulling a mandrel or stem into and/or through the shell whilst supporting the shell by means of an anvil which has at least the part which contacts the shell formed of a material which is sufficiently flexible to conform to the shape of the shell head surface.

A specific embodiment of the invention, and a modification thereof, will now be described by way of example and with reference to the accompanying drawings, in which.

Figure 3:
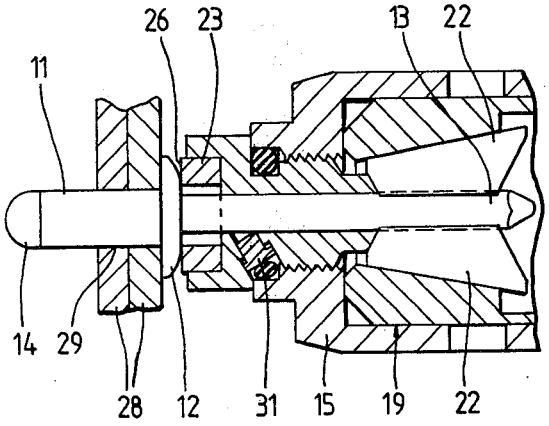
FIG. 3 is similar to FIG. 1, with the omission of part of the tool, and shows a rivet at the start of a placing operation.
Figure 4:
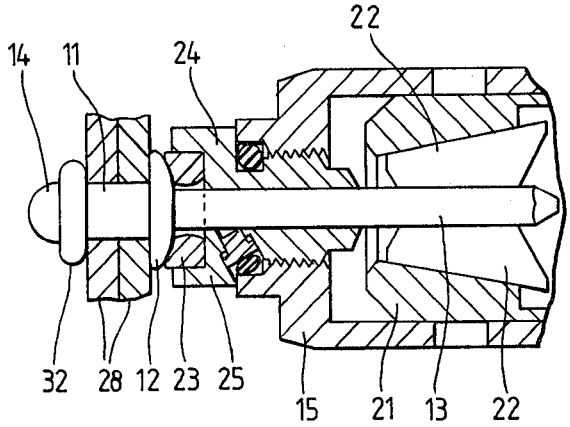
FIG. 4 is similar to FIG. 3 and shows the rivet and resilient anvil part just before the end of the placing operation.

The riveting tool of this example is intended to place shell-and-mandrel blind rivets illustrated in FIGS. 3 and 4, of the type known as "breakstem" rivets since the mandrel or stem breaks at the completion of the riveting operation. Essentially such a rivet comprises a tubular shell 11 of aluminium or steel having an enlarged head 12 at one end. Extending through the tubular shell is a steel mandrel 13 having an enlarged head 14 adjacent the tall end (i.e. the end remote from the head 12) of the shell. Such rivets are commercially available under the registered trade mark AVEX.

The riveting comprises a tubular body 15 having a front end wall 16 into which is screw-threadedly engaged an essentially tubular steel anvil 17 having a bore 18 through it co-axial with the body 15 and of sufficient diameter to accept the stem 13 of a rivet. Within the body 15 is housed mandrel-gripping and pulling means 19 in the form of an internally tapered collet 21 containing jaws 22. These jaws receive the end of a rivet mandrel and are arranged so that, when the tool is actuated (may be manually or by, for example, pneumatic power) the collet retracts and causes the jaws 22 to close together and grip the mandrel and pull it into the body. Meanwhile the anvil 17 contacts the head 12 of the rivet shell and supports it against movement.

The rivet placing operation is completed by the mandrel breaking at a weakened breakneck, under a predetermined tension load, leaving the mandrel head 14 and the adjacent part of the stem secured in the shell.

Such rivets and tools and their operation are well known in the art of riveting and will not be described further.

The tension at which the mandrel breaks may be as much as 1000 kg. force. This force appears as a thrust between the tool anvil and the shell head.

In prior riveting tools, the anvil has been formed of a hard material, normally steel, in order to withstand repeated use on, maybe, tens of thousands of rivets. It is frequently found that, when placing rivets with shells of a softer material e.g. aluminium, or soft steel, the anvil marks the shell head. This maybe unacceptable to the user. Furthermore, some rivet shells are now coloured, e.g. by painting, or colour anodizing, which provides a surface coating which is relatively soft and is therefore even more easily marked or damaged by a steel anvil, under the high contact forces involved. This problem occurs because in practice it is not possible to manufacture rivets so that the profile of the convex head of every rivet conforms exactly to the profile of the anvil face. Consequently, ring contact between the shell head and anvil face occurs, causing extremely high local pressure.

With the object of overcoming this problem, the anvil 17 of this example is provided with an annular disc 23 of resilient nylon-6 material which contacts the shell head 12. The disc is accommodated in a counterbore 24 in front of the steel anvil body 25. The counterbore is co-axial with bore 18, and also co-axial therewith is the bore 27 through the resilient disc. The diameter of the disc bore 27 is greater than the diameter of the bore 18 through the steel anvil body. The thickness of the disc 23 is slightly greater than the depth of the counterbore 24, so that the front face 26 of the disc protrudes in front of the front face of the steel anvil body 25.

FIGS. 3 and 4 illustrate the use of the riveting tool and rivet to join together two panels 28, through which a suitable hole 29 has been formed. The rivet stem 13 is inserted through the anvil bore 27 and 18, where it is retained by a sprung pin 31, until the shell head 12 contacts the front face 26 of the nylon disc 23. The shell is then inserted into the panel hole 29 until the head 12 also abuts the nearer panel, and the tail end of the shell protrudes beyond the rear panel. This is the position illustrated in FIG. 3.

The tool is then actuated to retract the collet 21 and cause the jaws 22 to grip and pull the mandrel with an increasing tension, the rivet shell head 12 being supported by the anvil nylon disc 23. The tail end of the rivet shell 11 deforms to provide a blind head 32, shown in FIG. 4, which illustrates the position just before the completion of the riveting operation at the breaking of the stem i.e. in FIG. 4 the mandrel tension and nylon disk compression are at a maximum. The front face of the resilient nylon disc 23 are deformed inwardly to conform to the shape of the rivet shell head 12 front face (in this example, a convex or so-called "snap head" shape). The front most part of the disc has also contracted radially inwardly, so that the diameter of the bore 27 is reduced at its front end. Since however the bore 27 through the nylon disc was initially greater in diameter than the bore 18 through the steel anvil body 25 (i.e. greater in diameter than the rivet stem 13), the bore 27 does not reduce in diameter sufficiently to engage the rivet stem 13. The part of the steel anxil body 25 surrounding the counterbore 18 limits the extent of deformation of the resilient disc 23 by preventing radially outward expension thereof, except possibly at the extreme front edge which is in front of the rigid body 25.

When the rivet mandrel 13 breaks, the rivet placing operation is complete.

As mentioned previously, the invention may be applied to a riveting tool in which the mandrel is reusable, the mandrel head being pulled through successive tubular rivets in turn, each rivet comprising only a shell. A plurality of tubular rivets may be initially loaded on the mandrel stem, or may be supplied repeatedly on the tail end of the mandrel. In both cases, rivets are fed forwardly along the mandrel (i.e. towards the mandrel head), and each rivet must thus pass forwardly through the anvil. To this end the anvil is split into separate parts, and commonly into two parts in a form similar to a pair of jaws (although the anvil parts to not necessarily grip the mandrel). Each anvil part is arranged to pivot about its rear end so that its front end can move readially outwardly, when a rivet is fed forwardly through it, the parts closing together (usually under the urging of a spring) behind the rivet to provide a firm abutment to support the rivet when the mandrel head is pulled through it. Such a split anvil for a pull-through riveting tool is well known in the art of blind riveting.

Figure 1:
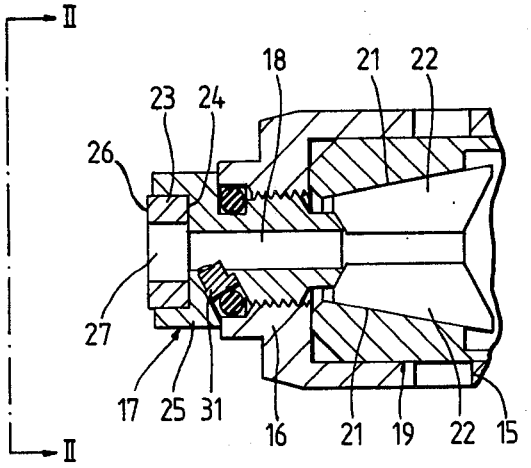
FIG. 1 is an axial section through an anvil and adjacent part of a riveting tool.
Figure 2:
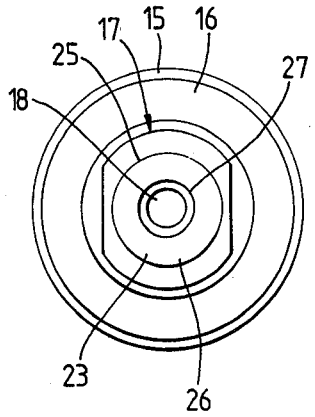
FIG. 2 is an end elevation of the tool taken on line II—II of FIG. 1.
Figure 5:
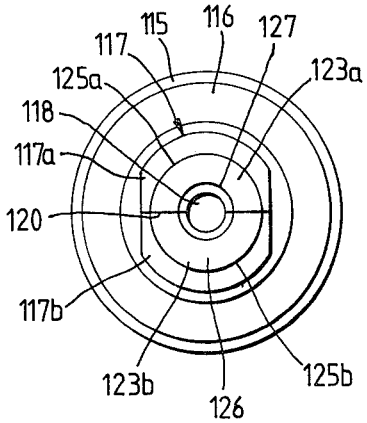
FIG. 5 is similar to FIG. 2 but illustrates a different type of tool.

Such a split anvil is illustrated in FIG. 5, which is similar to FIG. 2. This split anvil may be considered as a modification of that shown in FIG. 2, and like parts are denoted by like reference numerals but raised by 100. The anvil 117 is essentially similar to the anvil 17 split in half along an axial and diametral plane 120, into two generally semi-cylindrical halves. The sprung mandrel retainer pin 31 is omitted, and a known type of pivoting means for the two halves is provided. Thus the split anvil 117 comprises two halves **117*a* and 117*b*, each half comprising a rigid part 125*a* or 125*b* and a resilient part 123*a* or 123*b* respectively. The resilient parts 123*a* or 123*b* thus each comprise half of a circular disc of nylon-6 material, which is secured in the corresponding semi-circular half-counterbore in the front of the rigid part by means of adhesive. When the two anvil halves are closed together and under axial pressure supporting a rivet shell head when the mandrel head is pulled through it, the split anvil acts substantially similarly to the unsplit anvil illustrated in FIG. 2**.

The example anvil and the modification thereof described above are both advantageous in two respects. Firstly, the shell-contacting part of the anvil is soft enough that it does not damage the shell head surface, even when the latter has a painted finish. Secondly, the shell-contacting part of the anvil is flexible enough to conform to the shape of the shell head surface, thus maximizing the contact area and minimizing the contact pressure (for a given force) between the anvil and shell surface.

The invention is not restricted to the details of the foregoing example and modification thereof.

We claim:

1. An anvil secured to one end of a riveting tool of the type for use with a rivet having a shell with a head at one end which, in use, is supported against the anvil whilst the tool pulls a mandrel or stem into and through the shell, said anvil having at least a first part thereof which in use contacts the fastener shell head, said first part being formed of a resilient material which is strong enough to support the shell against the pull of the mandrel and is soft enough not to damage the surface of the shell head, including a rigid part providing a backing or mount for the said resilient part, and a bore extending through both parts for reception of the mandrel or stem during a riveting operation, the cross-sectional dimension of the bore being greater in the resilient part than in the rigid part.

2. An anvil as claimed in claim 1, in which said rigid part at least partially surrounds the said resilient part so that, in use of the anvil in a riveting operation, the rigid part limits the extent of deformation of the resilient part under the load applied thereto by the shell.

3. An anvil secured to one end of a riveting tool of the type for use with a rivet having a shell with a head at one end which, in use, is supported against the anvil whilst the tool pulls a mandrel or stem into and through the shell, said anvil having at least a first part thereof which in use contacts the fastener shell head, said first part being formed of a material which is sufficiently flexible to conform to the shape of the shell head surface, wherein said first part of said anvil includes means for preventing contact between said first part and said mandrel when said head of said shell is supported against said anvil, whereby said first part does not hinder movement of said mandrel relative to said anvil.

4. A method of placing a rivet comprising a shell, which method comprises:

pulling a mandrel or stem into and through the shell whilst supporting the shell by means of an anvil which has at least a first part which contacts the shell, said first part formed of a material which is sufficiently flexible to conform to the shape of the shell head surface; and preventing said first part of said anvil from contacting said mandrel during said pulling step, whereby said first part does not hinder movement of said mandrel relative to said anvil.

5. An anvil secured to one end of a riveting tool of the type for use with a rivet having a shell with a head at one end which, in use, is supported against the anvil whilst the tool pulls a mandrel or stem into and through the shell, said anvil having at least a first part thereof which in use contacts the fastener shell head, said first part being formed of a resilient material which is strong enough to support the shell against the pull on the mandrel and is soft enough not to damage the surface of the shell head, wherein said first part of said anvil includes means for preventing contact between said first part and said mandrel when said head of said shell is supported against said anvil, whereby said first part does not hinder movement of said mandrel relative to said anvil.

6. The anvil of claim 3 or 5 wherein said anvil includes a rigid second part having a first bore for accommodating said mandrel, and wherein said means for preventing contact comprises a second bore in said first part, said second bore being coaxial with said first bore and having a larger diameter than said first bore.

* * * * *